US011215431B1

(12) United States Patent
Gould et al.

(10) Patent No.: US 11,215,431 B1
(45) Date of Patent: Jan. 4, 2022

(54) ACTION PROVING/VERIFICATION INERT DEVICE FOR SMALL ARMS

(71) Applicant: U.S. Government as Represented by the Secretary of the Army, Dover, NJ (US)

(72) Inventors: Jeffrey Hayes Gould, Bangor, PA (US); Chad H. Sensenig, East Stroudsburg, PA (US); Joseph P. Chiarolanza, Oak Ridge, NJ (US); Tim L. Hinkey, Dingmans Ferry, PA (US); Andrzej Krysztofik, Elmwood Park, NJ (US); Santos Martinez, Dover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/017,774

(22) Filed: Sep. 11, 2020

(51) Int. Cl.
*F42B 8/08* (2006.01)

(52) U.S. Cl.
CPC ..... *F42B 8/08* (2013.01)

(58) Field of Classification Search
CPC ..... F42B 8/00; F42B 8/02; F42B 8/04; F42B 8/08
USPC ..... 102/444
See application file for complete search history.

(56) References Cited

U.S. PATENT DOCUMENTS 1,256,255 A * 2/1918 Porter ..... F42B 8/08 102/430
2,342,549 A * 2/1944 Le Gore ..... F42B 8/08 102/530
2,405,308 A * 8/1946 Jack ..... F42B 8/02 434/19
2,882,821 A * 4/1959 Benson ..... F42B 8/08 102/444
3,016,832 A * 1/1962 Carlson ..... F42B 8/08 102/444
3,027,840 A * 4/1962 Hannas ..... F42B 8/08 102/444
3,146,712 A * 9/1964 Eisinger ..... F42B 8/02 102/444
3,200,746 A * 8/1965 McConeghy ..... F42B 8/02 102/530
3,628,225 A * 12/1971 Parker ..... F42B 8/04 86/19.5
3,818,834 A * 6/1974 Baumgartener ..... F42B 33/04 102/464
4,450,769 A * 5/1984 Moser ..... F42B 8/08 102/444
4,719,859 A * 1/1988 Ballreich ..... F42B 8/04 102/444
5,027,710 A * 7/1991 Wittmann ..... F42B 8/12 102/513

(Continued)

*Primary Examiner* — Derrick R Morgan
(74) *Attorney, Agent, or Firm* — John P. DiScala

(57) ABSTRACT

Method of fabricating a dummy practice ammunition round to dynamically match behavior of an existing live ammunition round during manually cycling of the action, or other demonstration. A dummy practice ammunition round of identical contour is formed, having a center of gravity (mass) in the same position as on the existing live ammunition round. Weight is matched by removing or omitting material through coring into the case head of the round or by hollowing it out.

9 Claims, 9 Drawing Sheets

(56) References Cited

U.S. PATENT DOCUMENTS

| | | | | | |
|---|---|---|---|---|---|
| 5,259,319 | A * | 11/1993 | Dravecky | F42B 5/073 | 102/439 |
| 5,291,832 | A * | 3/1994 | Plummer | F42B 8/08 | 102/444 |
| 5,315,778 | A * | 5/1994 | Wolford | F41A 17/44 | 102/511 |
| 6,189,454 | B1 * | 2/2001 | Hunt | F42B 12/74 | 102/444 |
| 6,223,657 | B1 * | 5/2001 | Proffitt | F42B 8/08 | 102/444 |
| 6,305,290 | B1 * | 10/2001 | Stimmell | F42B 8/08 | 102/439 |
| 6,443,069 | B2 * | 9/2002 | Proffitt | F42B 8/08 | 102/444 |
| 9,423,221 | B2 * | 8/2016 | Bonner | F42B 8/08 | |
| 2003/0136294 | A1 * | 7/2003 | Guse | F42B 8/08 | 102/444 |
| 2008/0098922 | A1 * | 5/2008 | Gleue | F42B 5/16 | 102/447 |

* cited by examiner

ACTION PROVING/VERIFICATION INERT DEVICE FOR SMALL ARMS

U.S. GOVERNMENT INTEREST

The inventions described herein may be made, used, or licensed by or for the U.S. Government for U.S. Government purposes.

BACKGROUND AND FIELD OF THE INVENTION

The invention provides a robustly constructed inert dummy ammunition round that can effectively simulate a loaded round of standard model ammunition. The dummy ammunition round of the invention simulates size, shape, mass (weight), and also the center of gravity (mass) of subject standard model loaded ammunition rounds. The dummy ammunition round of the invention provides a very high fidelity to simulate loaded standard model ammunition, e.g., for proving the action/function of a firearm. The invention provides to a technician, for example, an authentic means of safely verifying the functioning of a firearm. The methods described here are also applicable but not limited to, ammunition for small arms such as rifles, machine guns, pistols, and shotguns. The invention provides a dummy round, as a robust item that can withstand the rough handling that is typical during standard use. Such verification is typically performed as a diagnostic tool before maintenance is performed, is conducted as part of maintenance, or is performed after maintenance as an evaluation of performed maintenance. In addition it can be used during weapons training and familiarization, weapons engineering & testing, and other demonstrations of firearms.

The simplest previous method used for these verification steps is to use live ammunition. This is advantageous since it verifies all aspects of functioning of the firearm including firing, however it is ultimately unsatisfactory since not all maintenance personnel have the facilities to perform live fire. It is also unsatisfactory from a safety standpoint since the firearm could be potentially not functioning correctly. This could lead to injury of persons or to damage of equipment. The most widely accepted previous method used for verification that addressed the concerns of live ammunition is to use inert ammunition built from live ammunition components but which omit the inclusion of energetic components such as the primer and propellant. This method results in a piece of ammunition that is close to the mass (weight) of the live ammunition and has a center of gravity (mass) that is close to that of the live ammunition. However, because the energetic components (e.g. primer and propellant) have been omitted there is a lack of fidelity between the live ammunition and the inert device. There is also a widely experienced problem of reduced durability that makes this method unacceptable. When inert ammunition is built by omitting the energetic components the resulting item typically only withstands a limited number of cycles in a firearm before it is damaged and unusable. Common modes of failure include projectiles shoved into the cases and also dented and deformed cases. These failure modes have been partially mitigated by including an inert filler into the cartridge case such as sand. Those methods have improved durability slightly, but it is still an issue. In order to address the above shortcomings another previous method used was to make solid, or almost solid, inert items that have the external dimensions of the live ammunition. These are most commonly made from aluminum but can also be found in brass and polymer or some combination of those and other materials. Some designs leave an open space for the firing pin of the firearm where the primer was, thereby avoiding impact with the firing pin during firing. Designs of this type are often termed "dummy rounds" in the vernacular. Other designs include a material or mechanism in the place of the primer that the firing pin contacts and claim to reduce the chance of damaging the firearm should the firing pin "over travel" by not making contact with a primer. Devices of this type are usually called "snap caps" in order to differentiate them from the "dummy rounds" described earlier. Depending on the design and material selected for a device of this type (of either the "dummy round" or the "snap cap" design) it might be more durable than an item made from ammunition components. However some devices that rely on materials such as polymer for the projectile or the cartridge case might not in fact be any more durable than the original ammunition components. Devices of this type generally have very low fidelity with the mass (weight) and center of gravity (mass) of live ammunition. This is unsatisfactory for evaluating the dynamic functioning of a firearm in which the mass (weight) and center of gravity (mass) of the ammunition could play an important role. This is particularly true of belt fed weapons but is also true of magazine fed and other weapons as well. The new results and advantages of the current invention are that the mass (weight) and center of gravity (mass) can be matched to live ammunition exactly (within specified tolerances) and the resulting item is durable enough to withstand repeated cycling through a firearm without deformation or loss of authenticity. Dummy rounds which do not adequately match the weight and center of gravity (mass) of live ammunition have been shown to 'wobble' when fed through belt fed machine guns, for example, which could for instance lead to damage, misfeeding, misfiring, etc. Testing has been performed using both steel and brass as material for the items but other materials could also be selected if they can match the mass characteristics of live ammunition and can withstand operational use in the weapons.

The invention uses data on the mass (weight) and center of gravity (mass) of a specific piece of live ammunition. In some case this data can be gathered through computer aided design (CAD) software with material properties assigned and with using the built-in analysis package. In other cases it is gathered experimentally with samples of loaded ammunition. The fidelity of this data is dependent on the fidelity of the inputs and/or the testing procedures. The invention also uses data on the external shape of specific ammunition. In some cases this data is published by one or more organizations such as SAAMI (Sporting Arms and Ammunition Manufacturers Institute) or CIP (Commission Inernationale Permanente pour l'epreuve des armes à feu portatives) or the data can be found in other publications. In other cases it is measured directly from the sample ammunition. The included sketch (FIG. 7) shows a cut-away view of a representative piece of inert ammunition using the design of this invention. The dimensions for the external surface 702, 704 in the area of the cartridge case 700 matches published data for this cartridge. The dimensions and profile of the external geometry 706 in the area of the projectile FIG. 6 matches measured data from a sample projectile. The overall length of the item is based on published data for overall length of a piece of loaded ammunition of this type. The dimensions of internal pockets 708 and 710 (V1 and V2 of FIG. 3) are selected for ease of manufacturing as well as removing sufficient material to match the mass (weight) and center of gravity (mass) of loaded live ammunition. The rear of the case 712 could include a smaller diameter opening that is large enough to provide clearance for the firearm's firing pin during operation as well as the tools needed to create the internal cavities; but not so large as to weaken the final device or to be visually unappealing. Depths and diameters of internal cylindrical pockets V1 and V2 and any other features (e.g. D1, L1, D2, L2) are adjusted first in a spreadsheet on a computer which holds previous data and measurements for existing standard rounds and for all the dummy round machining information. It has been found that some designs require 1 or more pockets of different dimensions D & L. The saved data in the computer represents difficultly obtained trial and error information gleaned from previously building successful dummy rounds for known live ammunition and is in an extensive table format. Therefore, an operator can look up the sizes needed for coring out the cylindrical pocket(s) for the given material(s) in the dummy round blank so as to over and over make a successful dummy round for all the known ammunition in the table. As newer dummy rounds are successfully fashioned for yet newer rounds, the successful information is constantly being added to the table(s) stored in the computer. The spreadsheet would contain calculations that predict the resulting mass and center of gravity (mass). Once a set of solutions is found to match acceptably close to the mass and center of gravity (mass) the loaded ammunition, the computer CAD model is updated with those values, for future reference. FIG. 4 was produced using the methods described above. The example in the figure is made from steel and has been cut away to show the internal cavities. FIG. 5 is made from brass and includes flutes on the external surface which is an optional inclusion to increase tactile identification of this device as an inert item. Since these external flutes affect mass and center of gravity (mass) of the final device, a different set of solutions for the internal cavities is needed when flutes are included or if dimensions of the flutes are adjusted.

BRIEF SUMMARY OF INVENTION

A method is provided of fabricating a dummy practice ammunition round to dynamically match behavior of an existing live ammunition round during manually cycling of the action, or other demonstration. A dummy practice ammunition round of identical contour is formed of solid material, having a center of gravity (mass) in the same position as on the existing live ammunition round. Weight is matched to the existing ammunition round which can be performed by removing material through coring into the back of the dummy practice round in the form of one or more coaxial symmetrical hollow cylinders or other cavity designs.

OBJECTS OF THE INVENTION

Accordingly, it is an object of the present invention to provide a method of fabricating and machining dummy practice ammunition rounds to dynamically match behavior of an existing live ammunition round during manually cycling of the action, or other demonstration.

Another object of the present invention is to provide a method of fabricating and machining dummy practice ammunition rounds to dynamically match behavior of an existing live ammunition round where the weight, contour, and center of gravity (mass) are determined empirically.

It is a further object of the present invention to provide a method of fabricating and machining dummy practice ammunition rounds to dynamically match behavior of an existing live ammunition round where the dummy practice ammunition round has a smooth contour or else where the dummy practice ammunition round has external flutes for better identification as being a dummy round.

It is yet another object of the present invention to provide a method of fabricating and machining dummy practice ammunition rounds to dynamically match behavior of an existing live ammunition round through having a center of gravity (mass) in the same position as on the existing live ammunition round, and removing material by coring through the case head or by hollowing out dummy practice ammunition round to match the dummy round weight to that of the existing round.

It is a still further object of the present invention to provide a method of fabricating and machining dummy practice ammunition rounds to dynamically match behavior of an existing live ammunition round where the weight is matched through coring of the dummy round by a technician, by hand, or on a screw machine, or by using 3D printing the objects with an intentionally designed hollowed core.

It is a still other object of the present invention to provide a table of known geometries for removal of material from a dummy practice round and ranges predetermined and optimized by trial and error usage and known to have been successful, and which table can be accessed for building new dummy rounds and also where said table could be stored in a computer, for convenience of access.

These and other objects, features and advantages of the invention will become more apparent in view of the within detailed descriptions of the invention, the claims, and in light of the following drawings and tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
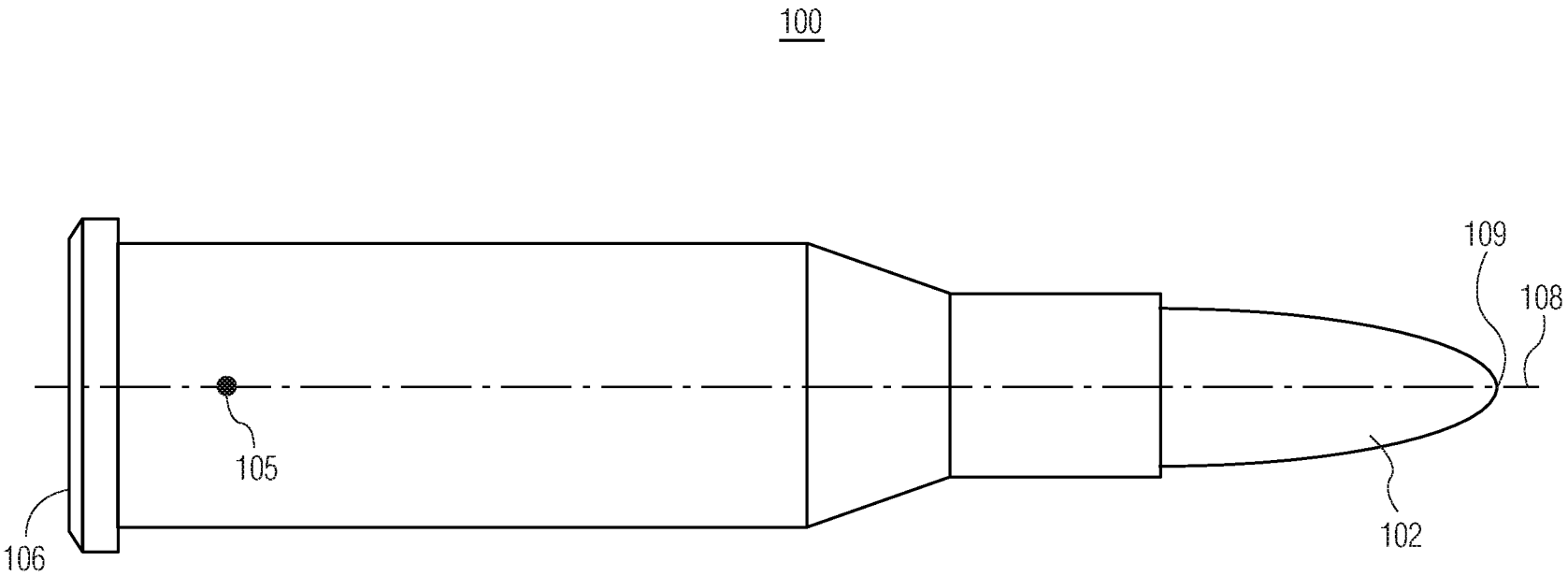
FIG. 1 shows a given live ammunition round the behavior of which is to be simulated by a dummy practice ammunition round, according to this invention.
Figure 2:
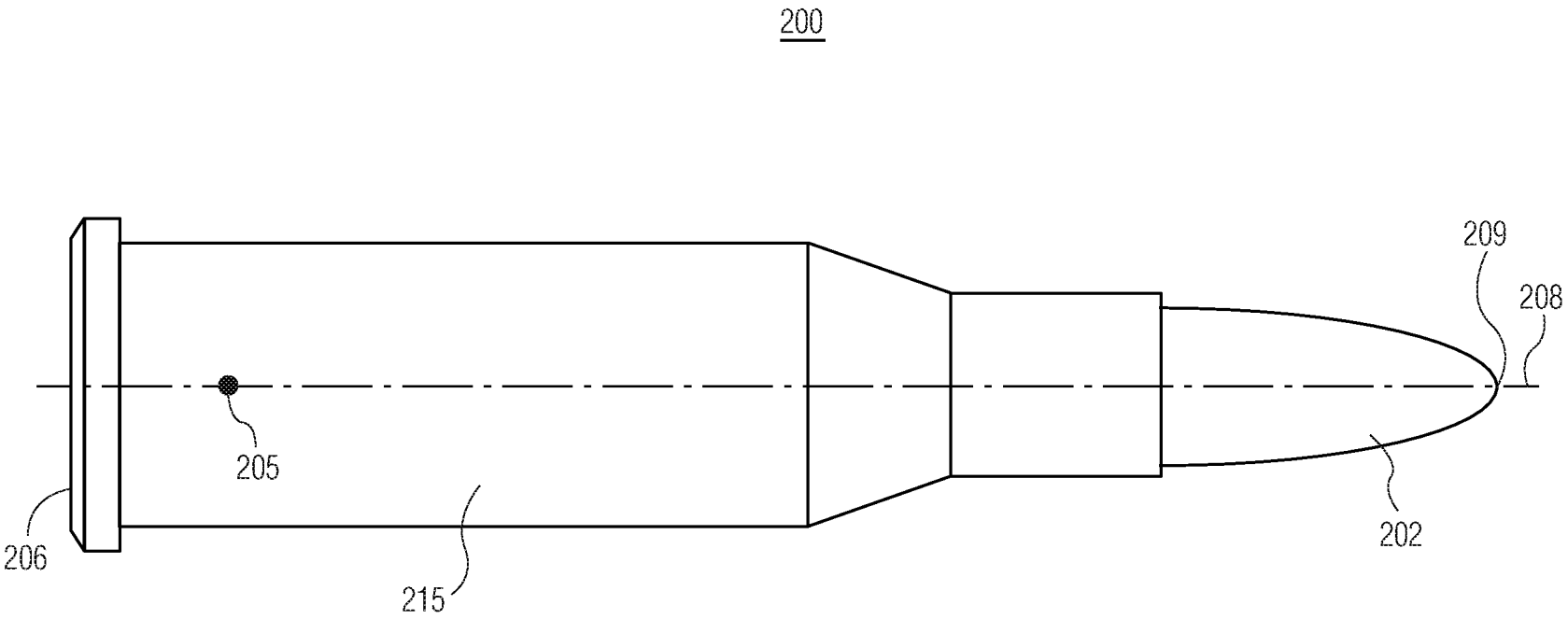
FIG. 2 shows a solid material, dummy practice ammunition round used for simulating the performance of the existing live ammunition round of FIG. 1, according to this invention.
Figure 3:
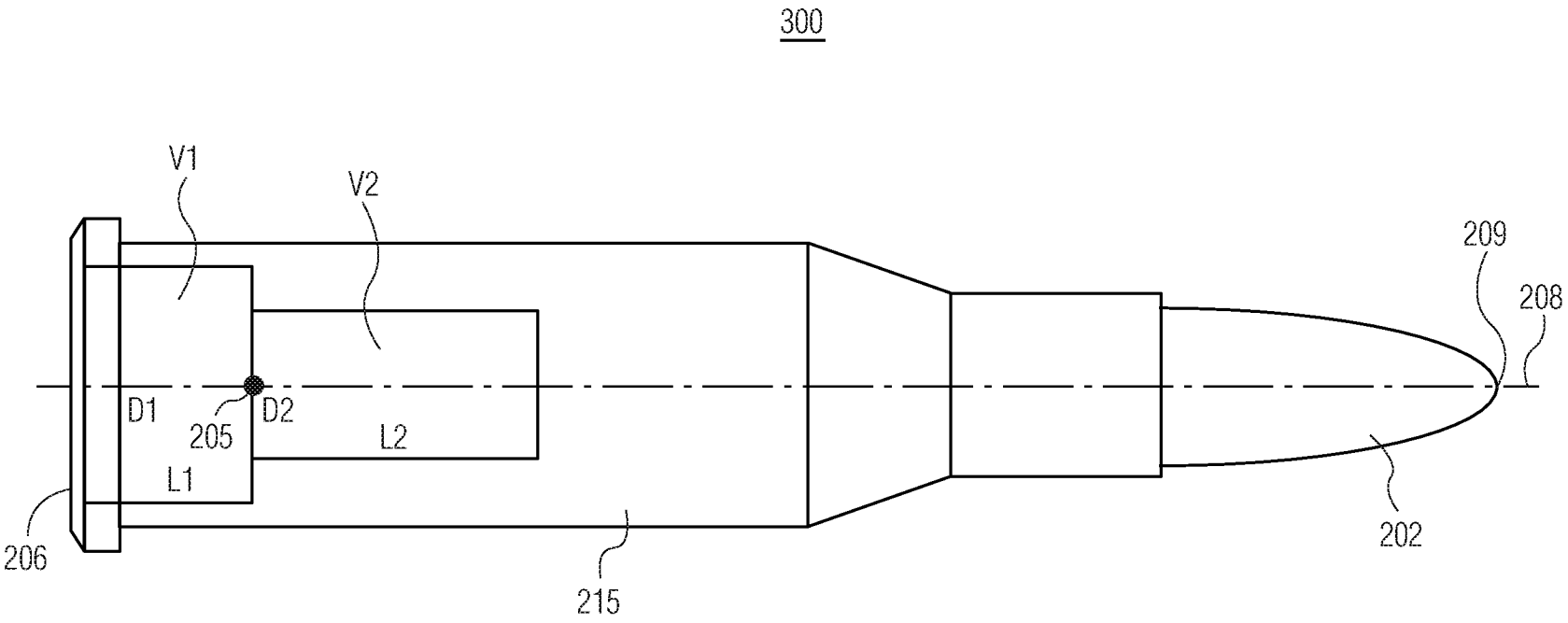
FIG. 3 shows the dummy practice ammunition round of FIG. 2, having volumes V1 and V2 of material removed or optimized therefrom, to simulate the weight and center gravity (mass) of the given existing live ammunition round, according to this invention.
Figure 4:
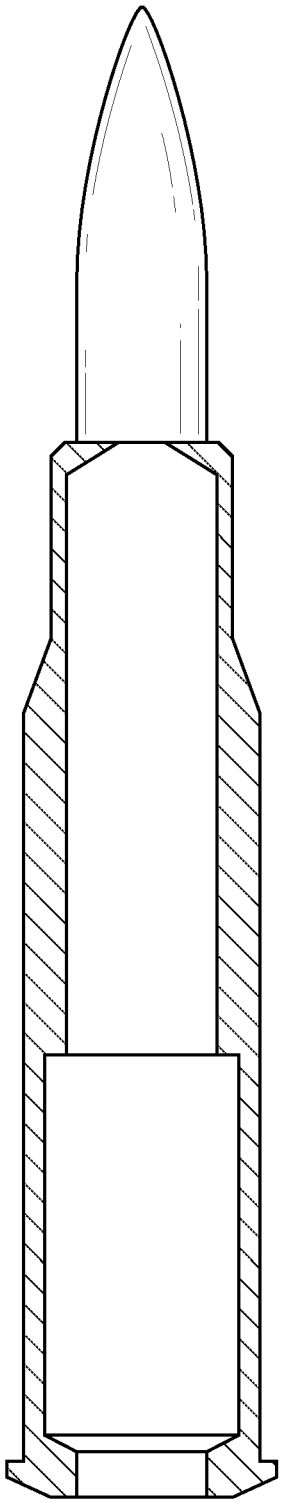
FIG. 4 illustrates a photo of a dummy practice round which has material removed or omitted from it in two cylindrical pockets in accordance with FIG. 3, according to this invention.
Figure 5:
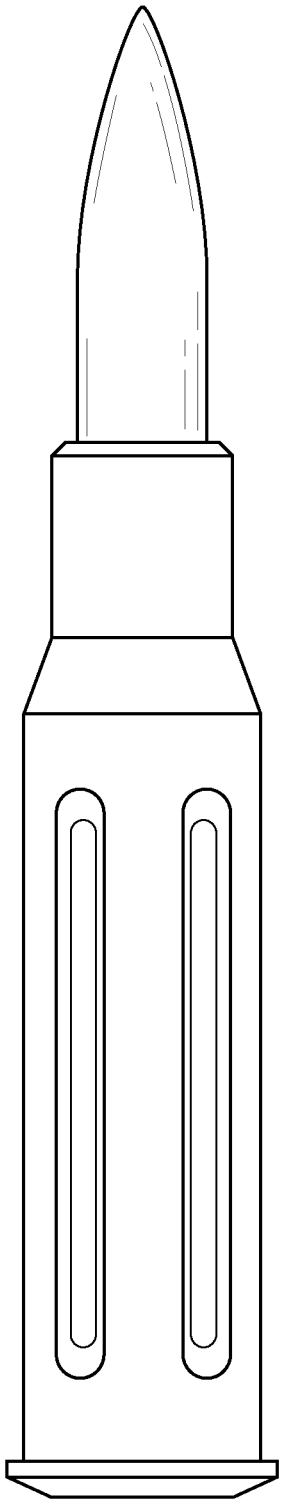
FIG. 5 illustrates a photo of the exterior of a dummy practice round in accordance with this invention which round includes longitudinal flutes around the exterior thereof.
Figure 6:
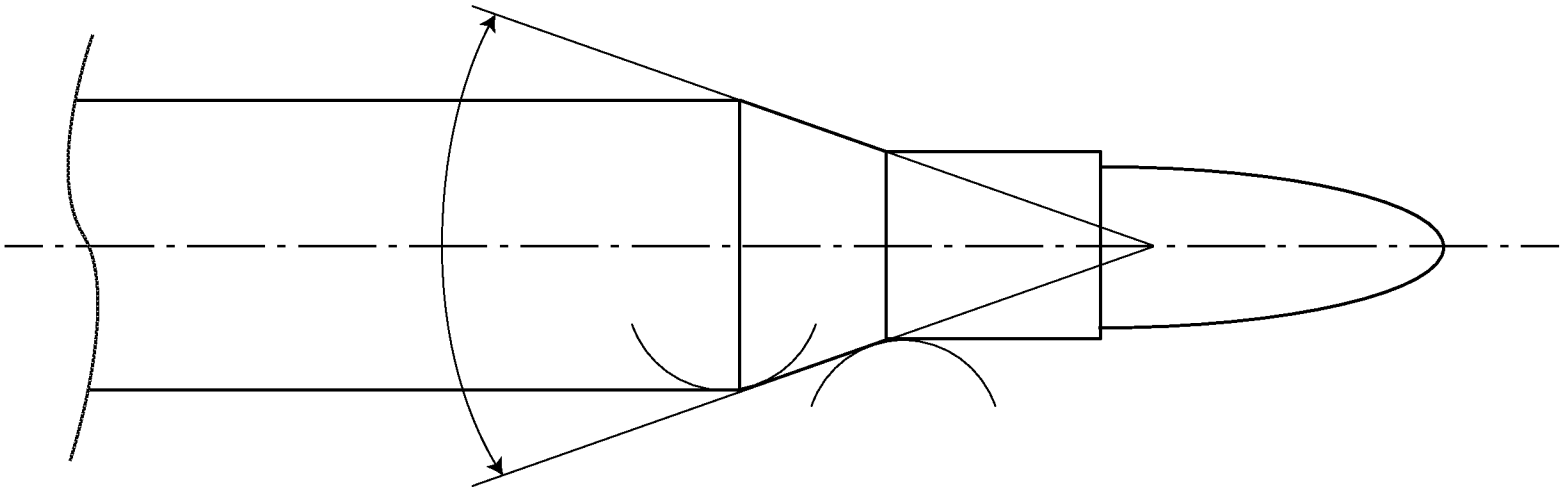
FIG. 6 shows a side plan view of a known 7.62×54R nonstandard ammunition round according to this invention, for which a simulation dummy round is sought to be produced.
Figure 7:
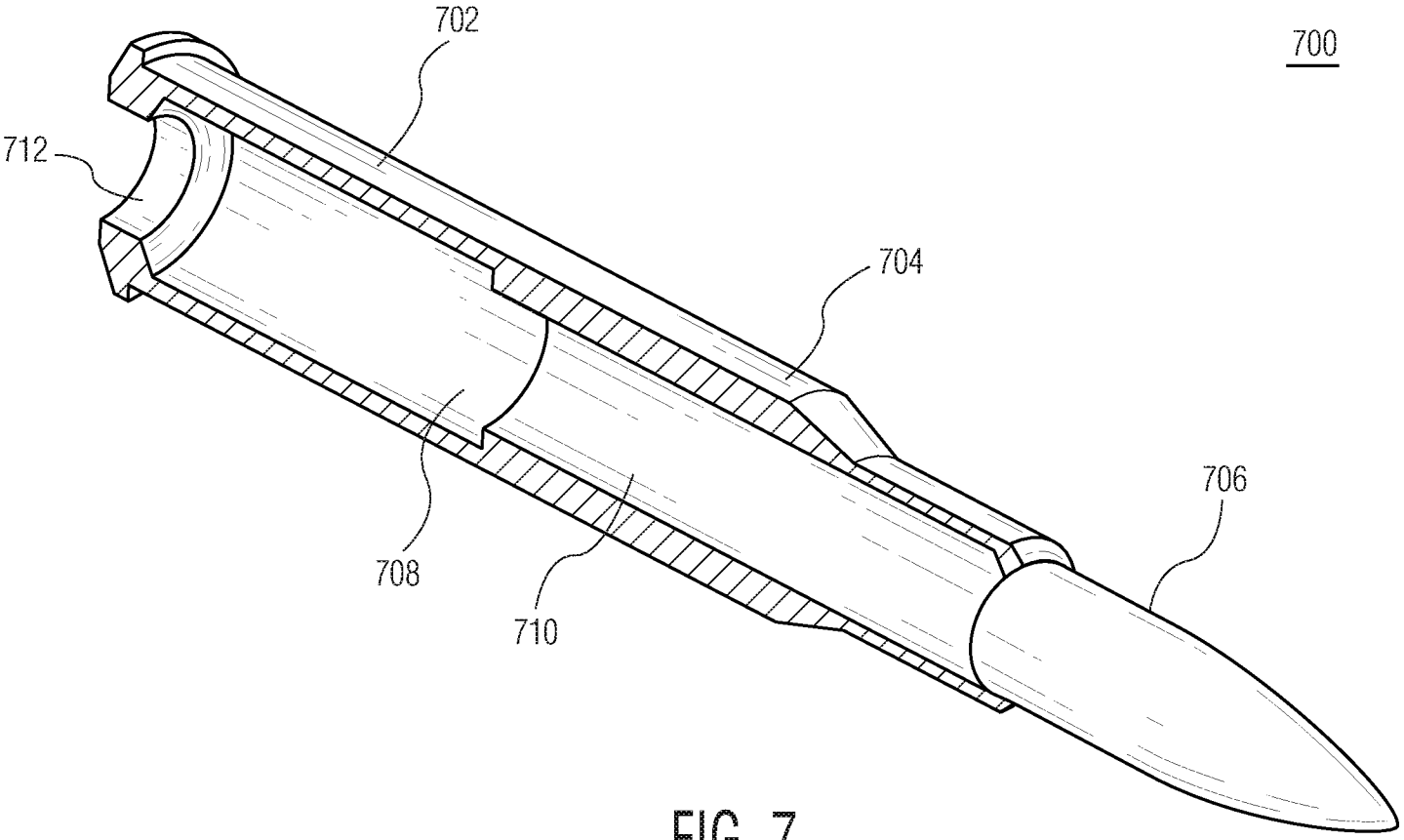
FIG. 7 shows a cut-away view of a representative piece of inert ammunition used to create a dummy practice round in accordance with this invention.

FIG. 1 shows a hypothetical ammunition round 100 to be simulated. Round 100 may be a NATO standard fully loaded cartridge or it may be a non-standard cartridge for simulation purposes. Round 100 is generally tubular shaped cross sectionally; it has a defined longitudinal axis 108, a defined front projectile 102, defined front most point 109, a defined case head 106, a given weight W1, and a defined center of gravity (mass) point 105. The center of gravity (mass) is a hypothetical point at which the round is equally balanced in all directions. If round 100 represents a standard model ammunition, the fully loaded weight, center of gravity (mass) and exact outside shape and dimensions are all known. If round 100 represents a nonstandard ammunition round, then these features could be determined empirically. In the case of a dummy round 200, 300 being produced in accordance to this invention, whether blank or processed according to the teachings of this invention, it will be presumed to be started of a solid material throughout of uniform density 215. It may be of aluminum, steel, brass, or other materials. The blank dummy round may be provided having a smooth outer contour as in FIG. 4 or a fluted outer contour as in FIG. 5 to better identify it as a dummy round (or perhaps also as an expedient to also remove weight). Successful dummy blanks have been recently made and tested for a nonstandard ammunition round 7.62×54 R (see FIGS. 6 and 7), 7.62×39, 9×18, 12.7×108. Furthermore. NATO standard 5.56×45, 7.62×51 and 0.50 Cal BMG, rounds have been made having the same weight as live rounds. These have all received favorable comments from field technicians or design engineers. The blank dummy round according to this invention, before processing such as in FIG. 2, starts out being made at weight W2, heavier than the (known) weight W1 of the standard (or nonstandard) model ammunition it is going to simulate, but having the same exact outer contours within specification thereof. As will be seen, for example in FIG. 3, pockets of material V1 and V2 will be removed (cored out) until the remaining weight of the dummy round blank then equals the weight within given tolerance of the fully loaded standard (or nonstandard) model ammunition it is going to be used to simulate. Moreover, and this is an important feature of this invention, the center of gravity (mass) in this processed dummy round blank 205, ideally still has to be at the same location 105 within given tolerance just as in the fully loaded standard (or non standard) model ammunition it is going to be used to simulate. Creating the necessary sizing in the pockets of removed or omitted material V1 and V2 to accomplish the duplication of final weight plus duplicated location of the center of gravity (mass) 105, represents a great accomplishment of this invention. Of note, the center of gravity (mass) 205 on the processed dummy round would tend to move as material is removed at V1 and V2. So, removal of material from the cylindrical pockets to lessen the weight of the processed dummy round may work at cross purposes to ensuring that the center of gravity (mass) 205 of the processed dummy round is at the desired location 105. As a practical expedient, the parameters L1, D1, L2, D2 may be designed by an operator without the aid of a computer, and the dummy round blank simply cored out, symmetrically along the defined longitudinal axis to get the weight of the dummy round down to the required amount, without taking into consideration if center of gravity (mass) 205 of the dummy round is precisely at location 105. That is to say, the imperfection of the dummy round center of gravity (mass) might conceivably be tolerated because the processed dummy round will function satisfactorily enough compared to other current dummy round alternatives. Moreover, the operator may have saved a table of acceptable range values for parameters L1, D1, L2, D2 from previous successful simulations of known ammunition model numbers and sizes, whereas such could be simply looked up in the table and the dummy round cored out manually. Such could also be saved in and looked up in, a computer as well, if desired. However, this invention seeks also to calculate algebraically the needed parameters of the cylindrical cutouts V1 and V2, from D1, L1, D2 and L2 in a hypothetical to serve as an example. In the example of FIG. 3, length L1 is chosen so it ends at point 205 equal to point 105, so the two volumes V1 and V2 can be placed back to back. Criteria 1: As seen in FIG. 3, to lower the final weight of this processed round to be equal to W1, then the total weight of removed volumes V1 plus V2 must be equal to W2−W1. The weights of either V1 and V2 can be known geometrically by density of the material, times Pi, times the length of a cylinder (L1 or L2), times the square of the diameter of the cylinder (D1 or D2), all the above divided by four. So as a first equation, (Density times Pi times L1 times the square of D1 all divided by 4)+(Density times Pi times L2 times the square of D2 all divided by 4)=W2−W1. Criteria 2: To keep the center of gravity (mass) 205 from moving from its position, and so it will still be the same place as 105 was, then the weight of volumes V1 and V2 should be kept equal in amount to one another. Therefore: (Density times Pi times L1 times the square of D1 all divided by 4)=(Density times Pi times L2 times the square of D2 all divided by 4). This reduces to L1 times the square of D1=L2 times the square of D2. If one assumed the first cylinder parameters for L1 and D1 as a starting point in an iteration process, then the values of L2 and D2 can certainly be calculated through solution of these simultaneous equations, or otherwise, so that both criteria are met. Such simultaneous equations could be solved to determine the precise parameters for cutting out the material, or these calculations could in theory actually be automated on a computer. To ensure that the center of gravity (mass) of the processed dummy round also to be at the precise location 105 as what the standard fully loaded cartridge 100 would have had, another way is there might also be used an iterative process, which may be done by computer, to try out proposed quantities of the various parameters here, L1, L2, D1, D2 to accomplish this. The iterative process could perhaps begin with W1, W2, material density as knowns and only one or more of L1, L2, D1, D2 as starting amounts while varying all the other parameters in the computer iteratively, to find good matches and good ranges for the parameters to make allowances for sufficient wall thickness for structural integrity. There may be more than one set of matches for L2 and D2 for instance, or conceivably if no matches are possible at all theoretically, then the computer might so inform the operator of that outcome. The pockets may be made of various shapes theoretically, but here as an example they were shown as two symmetrical hollow cylindrical cavities lying coaxially along the defined longitudinal axis 108, 208. For practical purposes of precision machining out of the material to make these cavities hollow, the first cavity V1 is made of wider diameter than the second cavity V2. This is also partly due to needing room to insert a cutting tool, and also through the first cylinder so as to be able to reach the second cylinder location to do some coring. Then, the second cavity V2 could be cored out as to diameter D2 and depth L2, as for example, on a Tsugami SS327-5AX screw machine device, to get a final, processed dummy round. As mentioned, other symmetrical shapes could be explored for fabricating the pockets of removed material. In this fashion, precision dummy rounds of superior quality can be produced for numerous standard/nonstandard fully loaded ammunition cartridges. This would certainly facilitate mass production techniques for these dummy practice rounds.

An alternative way to manufacture would be to utilize 3D printing enabling alternative methods of design that cannot be ascertained with conventional machining methods to include hollowing out the cavity having a smaller primer pocket which wouldn't be feasible for conventional machining.

Figure 8:
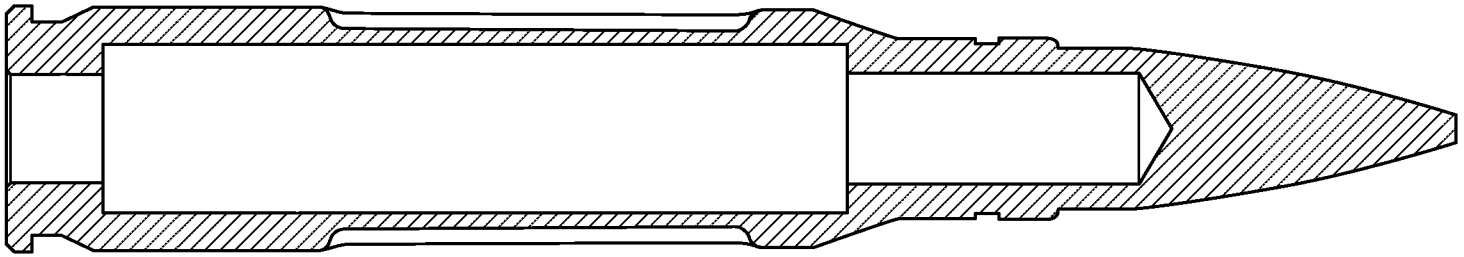
FIG. 8 shows another method of coring out coaxial cylindrical areas, to remove weight from the ammunition round.
Figure 9:
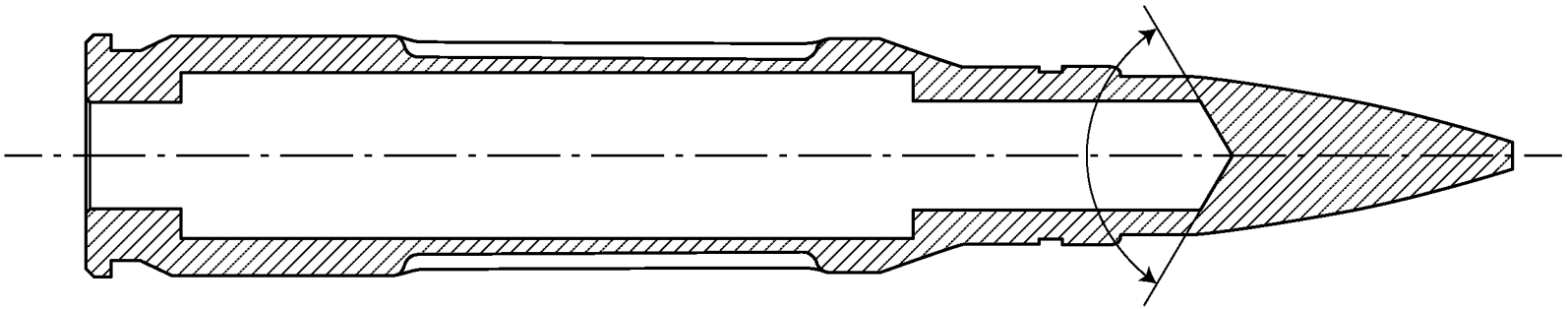
FIG. 9 shows a cross sectional view of the ammunition round, with an angular front shape conical portion in the foremost coaxial cylindrical cored out area.

Another method wherein the processing of the dummy rounds may be performed is by the 3D printing of the ammunition rounds. The ammunition round may be made up of multiple materials to include but not be limited to, filling the core hole with plastic epoxy, resin, polymer, or other materials to dampen/cushion the movement of the firing pin and to prevent nesting of rounds within one another and to prevent debris from entering. The bullets may be made so they can screw in/out of the case to simulate various cartridges in one design. FIG. 8 here shows another method of coring out coaxial cylindrical areas, to remove weight from the ammunition round. FIG. 9 here shows a cross sectional view of the ammunition round, with a front conical shaped portion in the foremost coaxial cylindrical cored out area.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A method of fabricating and machining a dummy practice ammunition round to dynamically match behavior of an existing ammunition round during manually cycling of the action said existing ammunition round having a known outside contour, a known weight (W1), a known longitudinal axis, known case head, and a known center of gravity, wherein the method comprises the steps of:

forming a dummy practice ammunition round of uniform density material, the dummy practice ammunition round having the same outer contour as the existing ammunition round, the dummy practice ammunition round having a weight (W2) which is greater than the known weight (W1) of the existing ammunition round, and removing material by coring, through the case head of the dummy practice ammunition round, a first symmetrical hollow cylinder (V1) at diameter (D1) and at a length (L1) which ends at a center of gravity, and then, starting at said center of gravity, coring out a second symmetrical hollow cylinder (V2) at diameter (D2) for a length of (L2), and;

wherein the volume of hollow cylinder (V1) equals the volume of hollow cylinder (V2), and wherein the weight of the removed hollow cylinder (V1) plus the weight of the removed hollow cylinder (V2) together reduce the weight (W2) of the dummy practice ammunition round to equal the known weight (W1) of the existing ammunition round, and furthermore the final center of gravity of the dummy practice ammunition round is in the same location as the known center of gravity on the existing ammunition round.

2. The method of claim 1 where the dummy practice ammunition round has a smooth contour.

3. The method of claim 1 where the dummy practice ammunition round has flutes.

4. The method of claim 1 where the dummy practice ammunition round is made of a material which includes brass, steel, aluminum or some other material.

5. The method of claim 1, comprising filling the cored hole with plastic, epoxy resin, polymer, or other materials to dampen the movement of a firing pin and to prevent nesting of rounds within one another and to prevent debris from entering the dummy ammunition round.

6. The method of claim 1 where a bullet can screw into the case to simulate various cartridges.

7. The method of claim 1 where the coring is done on a screw machine or other types of machine tools.

8. The method of claim 1 where the processing of the dummy rounds is performed using 3D printing.

9. The method of claim 1 where the coring is done by hand.

* * * * *